US005708956A

United States Patent [19]

Dunmead et al.

[11] Patent Number: 5,708,956

[45] Date of Patent: Jan. 13, 1998

[54] SINGLE STEP SYNTHESIS AND DENSIFICATION OF CERAMIC-CERAMIC AND CERAMIC-METAL COMPOSITE MATERIALS

[75] Inventors: Stephen D. Dunmead, Midland; Michael J. Romanowski, Clio, both of Mich.

[73] Assignee: The Dow Chemical Company, Midland, Mich.

[21] Appl. No.: 537,490

[22] Filed: Oct. 2, 1995

[51] Int. Cl.[6] ..... B22F 1/00

[52] U.S. Cl. ..... 419/12; 419/45

[58] Field of Search ..... 419/10, 12, 13, 419/14, 19, 24, 45, 23; 75/229, 230, 232

[56] References Cited

U.S. PATENT DOCUMENTS

| | | | |
|---|---|---|---|
| 4,431,448 | 2/1984 | Merzhanov et al. | 75/238 |
| 4,880,600 | 11/1989 | Moskowitz et al. | 419/12 |
| 4,909,842 | 3/1990 | Dunmead et al. | 75/236 |
| 4,946,643 | 8/1990 | Dunmead et al. | 419/12 |
| 5,256,368 | 10/1993 | Oden et al. | 419/10 |
| 5,364,442 | 11/1994 | Sekhar . | |

FOREIGN PATENT DOCUMENTS

| | | |
|---|---|---|
| 0046612 | 8/1981 | European Pat. Off. . |
| 0115688 | 12/1983 | European Pat. Off. . |
| 63-162835 | 7/1988 | Japan . |
| 64-65235 | 3/1989 | Japan . |
| 2274467 | 8/1994 | United Kingdom . |

OTHER PUBLICATIONS

Dunmead et al., "Simultaneous Synthesis and Densification of TiC/Ni--Al Composites", J. Mater. Sci. [26] 2410--2416 (1991).

Johnson et al., "Preparation and Processing Platelet--Reinforced Ceramics . . . ", Ceram. Eng. Sci. Proc. 10[7--8] 588--598 (1989).

Claar et al., "Microstructure and Properties of Platelet--Reinforced Ceramics . . . ", Ceram. Eng., Sci. Proc. 10[7--8] 599--609 (1989).

Johnson et al., "Kinetics of Formation of a Platelet--Reinforced Ceramic Composite . . . ," J. Am. Ceram. Soc. 74 (9) 2093--2101 (1991).

*Primary Examiner*---Charles T. Jordan
*Assistant Examiner*---Anthony R. Chi

[57] ABSTRACT

Ceramic-ceramic and ceramic-metal composite materials are disclosed which contain at least two ceramic phases and at least one metallic phase. At least one of these ceramic phases is a metal boride or mixture of metal borides and another of the ceramic phases is a metallic nitride, metallic carbide, or a mixture of metallic nitride and a metallic carbide. These composite materials may be made by a combustion synthesis process which includes the step of igniting a mixture of at least one element selected from titanium, zirconium, hafnium, vanadium, niobium, tantalum, chromium, molybdenum, tungsten, aluminum and silicon, or a combination of two or more thereof, at least one boron compound selected from boron nitride, boron carbide, or a combination thereof and an ignition temperature reducing amount of a metal selected from iron, cobalt, nickel, copper, aluminum, silicon, palladium, platinum, silver, gold, ruthenium, rhodium, osmium, and iridium, or a mixture of two or more thereof, provided that at least one of the aforementioned elements is different from at least one of the aforementioned metals. This process permits a high degree of control over the microstructure of the product and relatively low pressures are required to obtain high composite material density. A densified product having high density and a finely grained microstructure may be obtained by applying mechanical pressure during combustion synthesis. The composites have improved hardness, toughness, strength, resistance to wear, and resistance to catastrophic failure.

9 Claims, No Drawings

SINGLE STEP SYNTHESIS AND DENSIFICATION OF CERAMIC-CERAMIC AND CERAMIC-METAL COMPOSITE MATERIALS

BACKGROUND OF THE INVENTION

1. Field of the Invention

This invention is in the general area concerning the production of composite ceramic products. More specifically, it relates to the production of dense, finely grained, composite materials comprising ceramic and metallic phases via self-propagating high temperature synthesis (SHS) processes.

2. Description of Related Art

Self-propagating high temperature synthesis (SHS), alternatively and more simply termed combustion synthesis, is an efficient and economical process of producing refractory materials. [See for general background on combustion synthesis reactions: Holt, MRS Bulletin, pp. 60–64 (Oct. 1/Nov. 15, 1987): and Munir, Am. Ceram. Bulletin, 67 (2): 342–349 (Feb. 1988), which are fully incorporated herein by reference.] In combustion synthesis processes, materials having sufficiently high heats of formation are synthesized in a combustion wave which, after ignition, spontaneously propagates throughout the reactants, converting them into products. The combustion reaction is initiated by either heating a small region of the starting materials to ignition temperature whereupon the combustion wave advances throughout the materials, or by bringing the entire compact of starting materials up to the ignition temperature whereupon combustion occurs simultaneously throughout the sample in a thermal explosion.

Advantages of combustion synthesis include: (1) higher purity of products; (2) low energy requirements; and (3) relative simplicity of the process. [Munir, supra., at 342.] However, one of the major problems of combustion synthesis is that the products are "generally porous, with a sponge-like appearance." [Yamada et al., Am. Ceram. Soc., 64 (2): 319–321 at 319 (Feb. 1985).] The porosity is caused by three basic factors: (1) the molar volume change inherent in the combustion synthesis reaction; (2) the porosity present in the unreacted sample; and (3) adsorbed gases which are present on the reactant powders.

Because of the porosity of the products of combustion synthesis, the majority of the materials produced are used in powder form. If dense materials are desired, the powders then must undergo some type of densification process, such as sintering or hot pressing. The ideal production process for producing dense SHS materials combines the synthesis and densification steps into a one-step process. To achieve the goal of the simultaneous synthesis and densification of materials, three approaches have been used: (1) the simultaneous synthesis and sintering of the product; (2) the application of pressure during (or shortly after) the passage of the combustion front; and (3) the use of a liquid phase in the combustion process to promote the formation of dense bodies. [Munir, supra., at 347.]

U.S. Pat. No. 4,909,842, and its divisional U.S. Pat. No. 4,946,643, to Dunmead et al., which are incorporated herein by reference, describe how to make a dense composite material comprising certain finely grained ceramic phases and certain inter-metallic phases which overcome the problem of porosity of combustion synthesis products by applying relatively low pressure to certain selected materials during or immediately following the combustion reaction. The fine grained and dense materials produced by the processes disclosed therein have enhanced fracture and impact strength as well as enhanced fracture toughness.

There is nevertheless, a desire to make more advanced ceramic composite materials for a variety of wear, cutting, and structural applications and a desire for processes for making them which allows greater control of the ceramic composite microstructure and which can be conducted at lower ignition temperatures.

SUMMARY OF THE INVENTION

One embodiment of the present invention provides a multi-phase composite material consisting essentially of (a) at least two ceramic phases, one of which is a metallic boride or mixture of metallic borides and another of which is selected from the group consisting of metallic nitrides, metallic carbides and a mixture thereof, wherein the metal is selected from the group consisting of titanium, zirconium, hafnium, vanadium, niobium, tantalum, chromium, molybdenum, tungsten, aluminum and silicon, and a mixture of two or more thereof and (b) at least one metallic phase comprising a metal selected from the group consisting of iron, cobalt, nickel, copper, aluminum, silicon, palladium, platinum, silver, gold, ruthenium, rhodium, osmium, and iridium, or a mixture of two or more thereof, In another embodiment, the present invention relates to a multi-phase composite material comprising a) at least two ceramic phases, one of which is a metallic boride or mixture of metallic borides and another of which is selected from the group consisting of metallic nitrides, metallic carbides and a mixture thereof, wherein the metal is selected from the group consisting of titanium, zirconium, hafnium, vanadium, niobium, tantalum, chromium, molybdenum, tungsten, aluminum and silicon, and a mixture of two or more thereof and (b) at least one metallic phase comprising a metal selected from the group consisting of iron, cobalt, nickel, copper, aluminum, silicon, palladium, platinum, silver, gold, ruthenium, rhodium, osmium, and iridium, or a mixture of two or more thereof, and preferably contains no intermetallic phase, provided that at least one metal of the metallic phase(s) is different from at least one metal in the ceramic phases and (c) further provided that the composite material contains less than 5 weight percent intermetallic phase.

The invention further concerns processes for making a multi-phase composite material by combustion synthesis which comprises:

(a) providing an ignitable mixture having a reduced ignition temperature by mixing (1) at least one element selected from the group consisting of titanium, zirconium, hafnium, vanadium, niobium, tantalum, chromium, molybdenum, tungsten, aluminum and silicon, and a combination of two or more thereof, (2) at least one boron compound selected from the group consisting of boron nitride, boron carbide, and a combination of boron nitride and boron carbide, and (3) an ignition temperature reducing amount of a metal selected from the group consisting of iron, cobalt, nickel, copper, aluminum, silicon, palladium, platinum, silver, gold, ruthenium, rhodium, osmium, and iridium, or a mixture of two or more thereof, provided that at least one said element is different from at least one said metal, and (b) igniting the mixture prepared in (a).

This process may further comprise:

(c) applying mechanical pressure during the combustion synthesis initiated by ignition step (b).

The invention further concerns the products produced by said processes.

DETAILED DESCRIPTION OF THE INVENTION

The phrase "finely grained" is herein used to denote ceramic grains within a metallic matrix which are less than 10 microns in diameter, preferably less than 5 microns in diameter, more preferably less than 3 microns in diameter and still more preferably less than 2 microns in diameter.

The abbreviation "pbw" means "percent by weight" and is based on the composite material as a whole.

As used herein, the terms "binder" or "matrix" denote the components of the metallic phase(s) of the composite materials produced according to this invention.

The term "immediately" is herein defined to mean within a period of two minutes, preferably within 25 seconds, and more preferably within 5 seconds.

The term "dense" is used herein to denote a property of a material having a density which is greater than 85% of theoretical, preferably greater than 90%, more preferably greater than 95%, still more preferably greater than 97%, and even still more preferably greater than 99% of theoretical, wherein density is mass per unit volume. "Preferably" is herein used relatively depending on the application for which the composite materials are being produced.

The term "diluent" is used herein to denote a substance that is added to the reagents in the processes of this invention to decrease the combustion temperature of the reaction. This substance does not produce heat during the combustion reaction, that is, it is effectively inert in the processes of this invention.

The phrase "well dispersed" is herein used to indicate the homogeneous distribution of ceramic grains within the bulk of the matrix of the composite materials of this invention. It is preferred that the ceramic grains of the composite materials of this invention be not only finely grained but also spherical and well dispersed.

In the context of this invention, silicon is defined to be a metallic element.

In one embodiment, the composite material consists essentially of two ceramic phases and one metallic phase. The amount of the first ceramic phase in such a composite material is preferably in the range from about 10 pbw to about 90 pbw, more preferably from about 30 pbw to about 70 pbw. The amount of the second ceramic phase in the composite material is preferably in the range from about 10 pbw to about 90 pbw, more preferably from about 30 pbw to about 70 pbw. The ratio by weight of the first ceramic phase to the second ceramic phase is preferably in the range from 0.5 to 2.0, more preferably from about 0.7 to about 1.3. It is to be understood that the composite material of this material may contain more than one phase falling within the definition of "first ceramic phase" and more than one phase falling within the definition of "second ceramic phase".

The amount of metallic phase in the composite material is preferably from about 1 pbw to about 50 pbw, more preferably from about 5 pbw to about 30 pbw, and the amount of a metal selected from the group consisting of iron, cobalt, nickel, copper, aluminum, silicon, palladium, platinum, silver, gold, ruthenium, rhodium, osmium, and iridium, or a mixture of two or more thereof, in the metallic phase is preferably from about 20 to 100 weight percent, more preferably from about 50 to 100 weight percent. The amount of a metal selected from the group consisting of iron, cobalt, nickel, copper, aluminum, silicon, palladium, platinum, silver, gold, ruthenium, rhodium, osmium, and iridium, or a mixture of two or more thereof, in the composite material is preferably in the range from about 1 pbw to about 50 pbw. The weight ratio of the ceramic phases to the metallic phase is preferably from about 1.0 to about 99, or preferably from about 2.3 to about 19.0.

The composite material of this invention preferably contains less than 5 weight percent intermetallic phase and more preferably contains no intermetallic phase. The term intermetallic is herein defined to be a compound composed of two or more metals.

Preferred metals in the ceramic phase(s) include titanium and zirconium and preferred metals in the metallic phase include iron, cobalt, nickel, copper, aluminum and silicon (primarily for economic reasons). Other metals may be preferred for specialized applications for the composite material. Preferred combinations of ceramic phases and metallic phases in the multi-phase composite material according to the present invention include TiB2/TiN/Ni, ZrB2/TiN/Ni, TiB2/AlN/Ni, and TiB2/TiC/Ni.

It is preferred in the process according to this invention that the ignition temperature be adjusted to fall within the range from about 800° C. to about 1400° C., more preferable in the range from about 900° C. to about 1200° C.

It is also preferred to hold the temperature of the product produced by combustion synthesis at a temperature in the range from about 1000° C. to about 2000° C., more preferably from about 1200° C. to about 1600° C., for a time period from about 1 minute to about 2 hours, preferably from about 5 minutes to about 30 minutes, following ignition.

The source of ignition for the combustion synthesis processes of this invention is not critical. Any source providing sufficient energy for ignition would be suitable. Exemplary methods include sources such as laser beams, resistance heating coils, focused high intensity radiation lamps, electric arcs or matches, solar energy, and thermite pellets, among other sources.

The composite materials of this invention are prepared by combustion synthesis processes in which mechanical pressure may optionally be applied during or immediately following ignition to increase density. It is important that when pressure is applied, that it is applied when at least a portion of the components are in a liquid phase. Generally, this means that mechanical pressure, when applied, is applied for a time period of about 5 minutes to about 4 hours, and preferably for about 10 minutes to about 2 hours, during or immediately following ignition until the reaction has cooled sufficiently. The reaction has cooled sufficiently when there is no significant amount of liquid phase present. Preferably the reaction is cooled to a temperature below that at which the composite material would undergo thermal shock if the mechanical pressure were released. Thermal shock can cause cracking of the composite due to the stresses caused by uneven cooling. Preferably the composite material is cooled below 1300° C., more preferably below 1000° C., and even more preferably below 800° C., before removing mechanical pressure on the composite.

A commercially advantageous aspect of this invention is that the pressures required to produce a dense finely grained composite material of this invention are relatively low.

There is theoretically no upper limit on the pressure. The upper end of the pressure range is often the result of practical limitations, such as the capabilities of the equipment being used. As a result, the upper end of the pressure range may be about 325 MPa or higher, such as when using isostatic pressing, but may be less than about 55 MPa, and often less than 30 MPa, such as when using hot pressing equipment. It is preferred that the pressure applied be at least about 5 MPa and more preferably at least about 15 MPa. The pressure can be applied in a variety of ways including methods employing moulds, gasostats and hydrostats among other devices known in the art. Methods include hot pressing, either uniaxial or isostatic (including hot isostatic pressing), explosive compaction, high pressure shock waves generated by example from gas guns, rolling mills, vacuum pressing and other suitable pressure applying techniques.

It is preferred that any diluents to be mixed with the elements to be combusted according to this invention be pre-reacted components of the product ceramic and/or metallic phases. Preferred diluents include TiB2, TiN, AlN, ZrB2, TiC, and NiTi. It is further preferred that when the diluent is a ceramic, that the weight percent range of the ceramic diluent be from 0% to about 25% based on the total weight of the ceramic phase formed in the combustion synthesis reaction. It is also preferred that when the diluent is a metallic, the weight percent range of said metallic diluent be from about 0% to 50% based on the total weight of the metallic phase formed in the combustion synthesis reaction.

An advantageous aspect of this invention is that the complex reactions according to the present invention are often capable of spreading out combustion heat generation over an extended time frame so that the window for densification is widened. This allows for greater control over temperature and pressure conditions during densification which allows greater control over the microstructure of the product.

In addition, by adding a metal selected from the group consisting of iron, cobalt, nickel, copper, aluminum, silicon, palladium, platinum, silver, gold, ruthenium, rhodium, osmium, and iridium, or a mixture of two or more thereof, to the reaction mixture, the ignition temperature can be altered, allowing one to control the synthesis conditions (for example, temperature and time) which, in turn, allows one to control the microstructure. This allows one to make unique microstructures for particular applications which cannot be made by other techniques.

An important advantage of the process of this invention is that by varying the combustion synthesis parameters, the properties of the product can be tailored to meet specific application needs. The nature and composition of the product phases can be controlled by varying the ratios of the starting reagents, the level of mechanical pressure, by adding diluents and/or dopants, and by other methods apparent to those of ordinary skill in the art from the instant disclosure. In general, increasing the temperature of combustion has the effect of increasing the density of the product and of increasing the grain size of the product composite, whereas decreasing the reaction time has the effect of decreasing the grain size. The effect of most diluents in the systems herein outlined would be to both decrease the temperature of combustion and increase the reaction time. The temperature effect, however, is dominant because grain growth is exponentially dependent on temperature, and thus, the grain size of the product composite decreases.

One advantage obtained by the present invention is that composite materials can be obtained which have a finely grained microstructure as defined supra. This can be determined, for example, by measuring the mean discrete phase particle size using scanning electron microscopy. This, in turn, provides for unique improvements in properties such as hardness, toughness, strength, resistance to wear, and resistance to catastrophic failure.

Applications of the composite materials produced according to this invention include their use as cutting tools, wear parts, structural components, and armor, among other uses. Some uses to which the materials produced according to this invention can applied may not demand as high a density as others. For example, materials used for filters, industrial foams, insulation, and crucibles may not be required to be as dense as materials used for armor or abrasive and wear resistant materials. Therefore, the use to which the product composite material is to applied can be determinative of the conditions of synthesis that would be optimal from an efficiency and economy standpoint. For example, if the material need only be 90% dense rather than 95% dense, less pressure could be applied resulting in energy savings.

Other potential applications for the composite materials of this invention include abrasives, polishing powders, elements for resistance heating furnaces, shape-memory alloys, high temperature structural alloys, steel melting additives and electrodes for the electrolysis of corrosive media.

The following examples further illustrate the invention. The examples are not intended to limit the invention in any manner.

EXAMPLE 1

A 40 g mixture was formed that contained Ti (66.9 pbw), BN (23.1 pbw), and Ni (10 pbw). The following sources of raw materials were used: Ti-Johnson Mathey (Lot #F08C07), BN-USSR Academy of Sciences (Lot #P-Mm-557), and Ni-Aldrich Chemical Co. (Lot #03706HV). After the mixture was ball milled with WC-Co media for 15 minutes it was loaded into a grafoil lined graphite die approximately 2.54 cm (1 inch) in diameter. The die was then placed into the hot press and the hot press was evacuated and backfilled with nitrogen. The hot press was then heated at 30° C./minute and compressed to a pressure of 51.7 MPa (7500 psi) immediately after ignition at a temperature of approximately 1000° C. (as measured by a pyrometer on the outside of the carbon fiber hoop) the sample began to densify as detected by rapid movement of the ram. After approximately 3 minutes all ram travel stopped. The sample was then held at 1400° C. for 30 minutes and allowed to cool naturally with the pressure applied. After being removed from the hot press the density of the resultant product was measured by submersion to be 5.06 g/cc which correlates to 98.6% of theoretical. The theoretical density was calculated assuming the reaction produces a product that is 32.4 wt % (37.1 vol %) TiB2, 57.6 wt % (57.1 vol %) TiN, and 10.0 wt % (5.8 vol %) Ni. As expected, X-ray diffraction (XRD) of the product showed it to contain only TiN, TiB2, and some residual Ni. A backscattered scanning electron microscope image of the polished cross section of the dense product showed that both the TiN (gray phase) and the TiB2 (dark phase) are less than 2 microns in size and that the Ni (white phase) is not continuous.

EXAMPLE 2

The procedure described above was repeated save for the use of 160 g of the feed mixture in a 5.08 cm (2 inch) diameter die. The compressed to a pressure of 20.7 MPa (3000 psi) immediately after ignition. The sample began to densify at approximately the same temperature as that in Example 1. After cooling the sample was analyzed and found to be essentially identical to that produced in Example 1 (98.4% of theoretical density). This example demonstrated that relatively low pressures are needed for densification.

EXAMPLE 3

The procedure described above in Example 1 was repeated save for holding the sample at 1200° C. for 25 minutes after ignition. The product was found to have a density of 5.03 g/cc (98% of theoretical).

COMPARATIVE EXAMPLE

The procedure described above in Example 1 was repeated save for the composition of the feed mixture did not include Ni (25.7 pbw BN and 74.3 pbw Ti). In this case the ram travel did not begin until the hoop temperature reached 1700° C. (close to the melting point of Ti). The sample was held at 1800° C. for 15 minutes after ignition.

The final product was found to have a density of 4.79 g/cc (97.1% of theoretical). This example demonstrates that the presence of Ni lowers the ignition temperature.

EXAMPLE 4

A sample with the same composition as that used in Example 1 was isostatically pressed at 0.46 MPa (30 ksi) and ignited with no pressure applied. The product was found to be essentially identical to that produced above in Examples 1 and 2 with the exception that the density was 3.21 g/cc (62.6% of theoretical). This example demonstrated that mechanical pressure is needed for densification, but the porous product also has utility.

EXAMPLE 5

The procedure described above in Example 4 was repeated save for the use of 65 pbw Ti, 25 pbw B4C (ESK 1500TM, which is a product of Electroschmelzwerk Kempten of Munich, Germany), and 10 pbw Ni. The product was found to be composed of TiB2, TiC, and Ni, with trace amounts of TiNi3 and Ni3B. This example demonstrated the chemical versatility of the process.

Although the invention has been described in considerable detail through the preceding specific embodiments, it is to be understood that these embodiments are for purposes of illustration only. Many variations and modifications can be made by one skilled in the art without departing from the spirit and scope of the invention.

What is claimed is:

1. A process for making a multi-phase composite material by combustion synthesis which comprises:

(a) providing an ignitable mixture having a reduced ignition temperature by mixing (1) at least one element selected from the group consisting of titanium, zirconium, hafnium, vanadium, niobium, tantalum, chromium, molybdenum, tungsten, aluminum and silicon, and a mixture of two or more thereof (2) at least one of boron nitride and boron carbide, and (3) an ignition temperature reducing amount of a metal selected from the group consisting of iron, cobalt, nickel, copper, aluminum, silicon, palladium, platinum, silver, gold, ruthenium, rhodium, osmium, and iridium, or a mixture of two or more thereof, provided that at least one element is different from at least one metal, and (b) igniting the mixture prepared in (a) to essentially completely react the at least one element selected from the group consisting of titanium, zirconium, molybdenum, tungsten, aluminum and silicon, and a mixture of two or more thereof with the at least one of boron nitride and boron carbide.

2. The process according to claim 1 wherein the ignition temperature is within the range from about 1800° C. to 1400° C.

3. The process according to claim 1 wherein the ignition temperature is within the range from about 900° C. to about 1200° C.

4. The process according to claim 1 wherein the product produced by combustion synthesis initiated by step (b) is held at a temperature in the range from 1000° C. to 2000° C. for a time period from about 1 minute to about 2 hours following ignition.

5. The process according to claim 1 wherein the product produced by combustion synthesis initiated by step (b) is held at a temperature in the range from about 1200° C. to 1600° C. for a time period from about 5 minutes to about 30 minutes following ignition.

6. The process according to claim 1 comprising:

(c) applying mechanical pressure during the combustion synthesis initiated by ignition step (b).

7. The process according to claim 6 wherein the pressure applied is in the range from about 5 MPa to about 55 MPa.

8. The process according to claim 6 wherein the pressure applied is less than 30 MPa.

9. The process according to claim 1 wherein at least one element of the ignitable mixture (a) is titanium or zirconium and the ignition temperature reducing amount of metal in step (a) comprises nickel.

* * * * *